US010774291B2

(12) United States Patent
Klamo et al.

(10) Patent No.: US 10,774,291 B2
(45) **Date of Patent: *Sep. 15, 2020**

(54) AUTOMATIC DISHWASHING COMPOSITIONS WITH SPOT PREVENTION SURFACTANT

(71) Applicants: Dow Global Technologies LLC, Midland, MI (US); Rohm and Haas Company, Collegeville, PA (US)

(72) Inventors: Sara B. Klamo, Houston, TX (US); Edward D. Daugs, Midland, MI (US); Scott Backer, Phoenixville, PA (US); Severine Ferrieux, Grasse (FR); Paul Mercando, Pennsburg, PA (US); Eric P. Wasserman, Collegeville, PA (US)

(73) Assignees: Dow Global Technologies LLC, Midland, MI (US); Rohm and Haas Company, Philadelphia, PA (US)

( * ) Notice: Subject to any disclaimer, the term of this patent is extended or adjusted under 35 U.S.C. 154(b) by 38 days.

This patent is subject to a terminal disclaimer.

(21) Appl. No.: 16/307,019

(22) PCT Filed: Jun. 5, 2017

(86) PCT No.: PCT/US2017/035896

§ 371 (c)(1),
(2) Date: Dec. 4, 2018

(87) PCT Pub. No.: WO2017/218222

PCT Pub. Date: Dec. 21, 2017

(65) Prior Publication Data

US 2019/0218477 A1 Jul. 18, 2019

(30) Foreign Application Priority Data

Jun. 16, 2016 (EP) ..... 16290109

(51) Int. Cl.

| | |
|---|---|
| ***C11D 1/722*** | (2006.01) |
| ***C11D 3/10*** | (2006.01) |
| ***C11D 3/37*** | (2006.01) |
| ***B08B 3/04*** | (2006.01) |
| ***C11D 11/00*** | (2006.01) |

(52) U.S. Cl.

CPC ..... *C11D 1/722* (2013.01); *C11D 3/3757* (2013.01); *C11D 11/0023* (2013.01); *C11D 3/10* (2013.01)

(58) Field of Classification Search

CPC .. C11D 1/722; C11D 3/10; C11D 3/37; C11D 3/3757; B08B 3/04

See application file for complete search history.

(56) References Cited

U.S. PATENT DOCUMENTS

| | | | | |
|---|---|---|---|---|
| 3,862,243 | A * | 1/1975 | Bellos | C07C 43/11 568/625 |
| 4,340,766 | A | 7/1982 | Klahr et al. | |
| 5,126,068 | A | 6/1992 | Burke et al. | |
| 5,516,452 | A | 5/1996 | Welch et al. | |
| 6,828,295 | B2 | 12/2004 | Deak et al. | |
| 7,012,052 | B1 | 3/2006 | Kluesener et al. | |
| 7,563,759 | B2 | 7/2009 | Rogmann et al. | |
| 7,863,234 | B2 | 1/2011 | Maki et al. | |
| 8,334,323 | B2 | 12/2012 | Varineau et al. | |
| 2012/0234359 | A1 | 9/2012 | Krubasik et al. | |
| 2020/0017803 | A1 * | 1/2020 | Klamo | C11D 1/722 |

FOREIGN PATENT DOCUMENTS

| | | | | |
|---|---|---|---|---|
| DE | 3005515 | A1 | 8/1981 | |
| EP | 687720 | A2 | 12/1995 | |
| JP | 2004067707 | | 3/2004 | |
| JP | 2004091686 | | 3/2004 | |
| JP | 2007119753 | A | 5/2007 | |
| JP | 2007238921 | A | 9/2007 | |
| JP | 2010222501 | A | 10/2010 | |
| WO | 1996012001 | A1 | 4/1996 | |
| WO | 2000050550 | A2 | 8/2000 | |
| WO | 2000050551 | | 8/2000 | |
| WO | WO 00/50551 | * | 8/2000 | C11D 1/72 |
| WO | 2010067054 | | 6/2010 | |
| WO | 2011042737 | A1 | 4/2011 | |
| WO | 2016001327 | A1 | 1/2016 | |

* cited by examiner

*Primary Examiner* — Brian P Mruk
(74) *Attorney, Agent, or Firm* — Thomas S. Delbert

(57) ABSTRACT

An automatic dishwashing composition is provided including a dispersant polymer; a builder; and a surfactant, wherein the surfactant is a fatty alcohol alkoxylate of formula I:

(I)

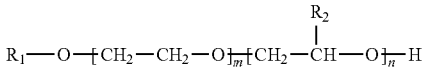

wherein $R_1$ is a linear or branched, saturated $C_{8-24}$ alkyl group; $R_2$ is a linear saturated $C_{2-8}$ alkyl group; m has an average value of 22 to 42; n has an average value of 4 to 12; wherein m+n is an average value of 26 to 54; wherein the fatty alcohol alkoxylate has an average ethyleneoxy unit concentration per molecule, X, of >45 wt %; and, wherein the fatty alcohol alkoxylate has a ratio, Z, equal to X divided by n, wherein the ratio, Z, is <9.5.

6 Claims, No Drawings

AUTOMATIC DISHWASHING COMPOSITIONS WITH SPOT PREVENTION SURFACTANT

The present invention relates to surfactants for spot prevention compositions. In particular, the present invention relates to automatic dishwashing compositions incorporating such surfactants having reduced spotting on dishware.

Automatic dishwashing compositions are generally recognized as a class of detergent compositions distinct from those used for fabric washing or water treatment. Automatic dishwashing compositions are expected by users to produce a spotless and film-free appearance on washed articles after a complete cleaning cycle.

A family of alcohol ethoxylates are disclosed by Burke et al. in U.S. Pat. No. 5,126,068 for use in streak free aqueous hard surface cleaning compositions. Burke et al. disclose cleaning composition containing, inter alia, an alcohol ethoxylate of the formula $$RO(CH_2CH_2O)_x(CH_2CH(CH_3)O)_y(CH_2CH(CH_2CH_3)O)_zH$$

wherein R is an alkyl chain whose length is from 8 to 15 carbon atoms, x is a number from about 4 to 15, y is a number from about 0 to 15, and z is a number from about 0 to 5.

Notwithstanding phosphate-free compositions are increasingly desirable. Phosphate-free compositions rely on non-phosphate builders, such as salts of citrate, carbonate, bicarbonate, aminocarboxylates and others to sequester calcium and magnesium from hard water and block them from leaving an insoluble visible deposit on the dishware following drying. Phosphate-free compositions, however, have a greater tendency to leave spots on glassware and other surfaces.

Compositions that exhibit improved properties in automatic dishwashing and that are phosphate-free would be an advance in the industry. Accordingly, there remains a need for new surfactants having anti-spotting properties. In particular, there remains a need for new surfactants having anti-spotting properties that facilitate automatic dishwashing formulations that are both phosphate-free and anti-spotting.

The present invention provides an automatic dishwashing composition comprising: a dispersant polymer comprising monomer units of at least one of acrylic acid, methacrylic acid, itaconic acid and maleic acid; a builder; and a surfactant, wherein the surfactant is a fatty alcohol alkoxylate of formula I:

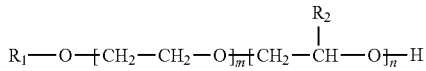

(I)

wherein $R_1$ is a linear or branched, saturated $C_{8-24}$ alkyl group; $R_2$ is a linear saturated $C_{2-8}$ alkyl group; m has an average value of 22 to 42; n has an average value of 4 to 12; wherein m+n is an average value of 26 to 54; wherein the fatty alcohol alkoxylate of formula I has an average ethyleneoxy unit concentration per molecule, X, of >45 wt %; and, wherein the fatty alcohol alkoxylate of formula I has a ratio, Z, equal to X divided by n, wherein the ratio, Z, is <9.5.

The present invention provides an automatic dishwashing composition comprising: a dispersant polymer, wherein the dispersant polymer comprises at least one of a homopolymer of (meth)acrylic acid, a copolymer of (meth)acrylic acid and at least one other ethylenically unsaturated monomer, and salts thereof; a builder; and a surfactant, wherein the surfactant is a fatty alcohol alkoxylate of formula I; wherein $R_1$ is a linear or branched, saturated $C_{8-24}$ alkyl group; $R_2$ is a linear saturated $C_{2-8}$ alkyl group; m has an average value of 22 to 42; n has an average value of 4 to 12; wherein m+n is an average value of 26 to 54; wherein the fatty alcohol alkoxylate of formula I has an average ethyleneoxy unit concentration per molecule, X, of >45 wt %; and, wherein the fatty alcohol alkoxylate of formula I has a ratio, Z, equal to X divided by n, wherein the ratio, Z, is <9.5.

The present invention provides an automatic dishwashing composition comprising: a dispersant polymer, wherein the dispersant polymer comprises at least one of a homopolymer of (meth)acrylic acid, a copolymer of (meth)acrylic acid and at least one other ethylenically unsaturated monomer, and salts thereof; a builder, wherein the builder is selected from the group consisting of alkali metal carbonate, alkali metal bicarbonate, alkali metal percarbonate, alkali metal citrate, ammonium carbonate, ammonium bicarbonate, and ammonium percarbonate; and a surfactant, wherein the surfactant is a fatty alcohol alkoxylate of formula I; wherein $R_1$ is a linear or branched, saturated $C_{8-24}$ alkyl group; $R_2$ is a linear saturated $C_{2-8}$ alkyl group; m has an average value of 22 to 42; n has an average value of 4 to 12; wherein m+n is an average value of 26 to 54; wherein the fatty alcohol alkoxylate of formula I has an average ethyleneoxy unit concentration per molecule, X, of >45 wt %; and, wherein the fatty alcohol alkoxylate of formula I has a ratio, Z, equal to X divided by n, wherein the ratio, Z, is <9.5.

The present invention provides a method of cleaning an article in an automatic dishwashing machine, comprising: providing at least one article; providing an automatic dishwashing composition of the present invention; and, applying the automatic dishwashing composition to the at least one article.

DETAILED DESCRIPTION

When incorporated in automatic dishwashing compositions (particularly phosphate-free automatic dishwashing compositions), the surfactant fatty alcohol alkoxylate as particularly described herein dramatically improve the anti-spotting performance of the automatic dishwashing composition.

Unless otherwise indicated, numeric ranges (for instance, "from 2 to 10") are inclusive of the numbers defining the range (e.g., 2 and 10).

Unless otherwise indicated, ratios, percentages, parts, and the like are by weight. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As used herein, unless otherwise indicated, the terms "molecular weight" and "Mw" are used interchangeably to refer to the weight average molecular weight as measured in a conventional manner with gel permeation chromatography (GPC) and conventional standards, such as polyethylene glycol standards. GPC techniques are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Molecular weights are reported herein in units of Daltons.

The term "ethylenically unsaturated" is used to describe a molecule or moiety having one or more carbon-carbon double bonds, which renders it polymerizable. The term "ethylenically unsaturated" includes monoethylenically unsaturated (having one carbon-carbon double bond) and multi-ethylenically unsaturated (having two or more carbon-carbon double bonds). As used herein the term "(meth) acrylic" refers to acrylic or methacrylic.

The terms "Ethyleneoxy" and "EO" as used herein and in the appended claims refer to a —$CH_2$—$CH_2$—O— group.

The term "phosphate-free" as used herein and in the appended claims means compositions containing less than 0.5 wt % (preferably, less than 0.2 wt %; more preferably, less than 0.1 wt %; most preferably, less than the detectable limit) of phosphate (measured as elemental phosphorus).

Preferably, the automatic dishwashing composition of the present invention, comprises: a dispersant polymer comprising monomer units of at least one of acrylic acid, methacrylic acid, itaconic acid and maleic acid; a builder; and a surfactant, wherein the surfactant is a fatty alcohol alkoxylate of formula I:

(I)

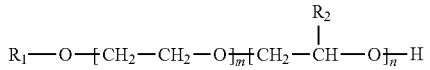

wherein $R_1$ is a linear or branched, saturated $C_{8-24}$ alkyl group (preferably, a linear or branched, saturated $C_{12-20}$ alkyl group; more preferably, wherein the linear or branched, saturated $C_{12-20}$ alkyl group is selected from the group consisting of a dodecyl group, a tetradecyl group, a hexadecyl group, an octadecyl group and an eicosyl group); $R_2$ is a linear saturated $C_{2-8}$ alkyl group (preferably, a linear saturated $C_{2-6}$ alkyl group; more preferably, a linear saturated $C_{2-4}$ alkyl group; most preferably, a $C_2$ alkyl group); m has an average value of 22 to 42 (preferably, 23 to 33; more preferably, 24 to 32; most preferably, 25 to 31); n has an average value of 4 to 12 (preferably, 5 to 11; more preferably, 6 to 11; most preferably, 7 to 10); wherein m+n is an average value of 26 to 54 (preferably, 30 to 50; more preferably, 30 to 45; most preferably, 30 to 40); wherein the fatty alcohol alkoxylate of formula I has an average ethyleneoxy unit concentration per molecule, X, of >45 wt % (preferably, ≥50 wt %; more preferably, >45 to 64.5 wt %; most preferably, 50 to 64.5 wt %); and, wherein the fatty alcohol alkoxylate of formula I has a ratio, Z, equal to X divided by n, wherein the ratio, Z, is <9.5 (preferably, 4 to 9.4; more preferably, 5 to 9.2). The surfactant may be a mixture of fatty alcohol alkoxylate compounds of formula I, wherein the surfactant is a mixture containing a range of alkyl groups $R_1$ and $R_2$ differing in carbon number, but having average carbon numbers that conform to the ranges described above.

Preferably, the automatic dishwashing composition of the present invention, comprises: at least 0.2 wt % (preferably, at least 1 wt %), based on the dry weight of the automatic dishwashing composition, of the surfactant, wherein the surfactant is a fatty alcohol alkoxylate of formula I as described above. Preferably, the automatic dishwashing composition of the present invention, comprises: 0.2 to 15 wt % (preferably, 0.5 to 10 wt %; more preferably, 1.5 to 7.5 wt %), based on the dry weight of the automatic dishwashing composition, of the surfactant, wherein the surfactant is a fatty alcohol alkoxylate of formula I as described above.

The surfactant fatty alcohol alkoxylate of formula I used in the automatic dishwashing composition of the present invention can be readily prepared using known synthetic procedures. For instance, a typical procedure for preparing the compounds is as follows. An alcohol conforming to the formula $R_1OH$ (wherein $R_1$ is a linear or branched, saturated $C_{8-24}$ alkyl group) is added to a reactor, and heated in the presence of a base (for example, sodium hydride, sodium methoxide or potassium hydroxide). The mixture should be relatively free of water. To this mixture is then added the desired amount of ethylene oxide, EO, under pressure. After the EO has been consumed (as indicated by a substantial fall in reactor pressure), the resulting ethoxylated alcohol can be subjected to reaction with an alkylene oxide (wherein the alkylene oxide contains from 4 to 10 carbon atoms) at a molar ratio of ethoxylated alcohol to alkylene oxide of 1:4 to 1:12 under basic conditions. The molar ratio of catalyst to ethoxylated alcohol can be between 0.01:1 and 1:1 (preferably, 0.02:1 to 0.5:1). The reaction to form the ethoxylated alcohol and the further reaction with the alkylene oxide are typically conducted in the absence of solvent and at temperatures of 25 to 200° C. (preferably, 80 to 160° C.).

Preferably, the dispersant polymer used in the automatic dishwashing composition of the present invention, comprises monomer units of at least one of acrylic acid, methacrylic acid, itaconic acid, and maleic acid. Preferably, the dispersant polymer comprises units of (meth)acrylic acid. Preferably, the dispersant polymer has a weight average molecular weight, Mw, of ≥2,000 (more preferably, ≥3,000; most preferably, ≥4,000) Daltons; and of ≤100,000 (more preferably, ≤70,000; more preferably, ≤50,000; more preferably, ≤30,000; more preferably, ≤25,000; more preferably, ≤20,000) Daltons. Preferably, the dispersant polymer has a weight average molecular weight, Mw, of 2,000 to 40,000 (more preferably, 4,000 to 20,000) Daltons.

Preferably, the dispersant polymer used in the automatic dishwashing composition of the present invention comprises at least one of a homopolymer of (meth)acrylic acid, a copolymer of (meth)acrylic acid with at least one other ethylenically unsaturated monomer, and salts thereof. More preferably, the dispersant polymer used in the automatic dishwashing composition of the present invention comprises at least one of a homopolymer of (meth)acrylic acid, a copolymer of (meth)acrylic acid with at least one other ethylenically unsaturated monomer, and salts thereof; wherein the copolymer of (meth)acrylic acid with at least one other ethylenically unsaturated monomer includes a copolymer of methacrylic acid and acrylic acid. Most preferably, the dispersant polymer used in the automatic dishwashing composition of the present invention is a homopolymer of (meth)acrylic acid and salts thereof (preferably, a homopolymer of (meth)acrylic acid).

Preferably, the copolymer of (meth)acrylic acid with at least one other ethylenically unsaturated monomer, includes residues selected from the group consisting of esters of (meth)acrylic acid (e.g., ethyl acrylate, butyl acrylate, ethyl methacrylate, butyl methacrylate), styrene, sulfonated monomers (e.g., 2-acrylamido-2-methylpropane sulfonic acid (AMPS), 2-methacrylamido-2-methylpropane sulfonic acid, 4-styrenesulfonic acid, vinylsulfonic acid, 3-allyloxy, 2-hydroxy-1-propane sulfonic acid (HAPS), 2-sulfoethyl (meth)acrylic acid, 2-sulfopropyl(meth)acrylic acid, 3-sulfopropyl(meth)acrylic acid, 4-sulfobutyl(meth)acrylic acid); substituted (meth)acrylamides (e.g., tert-butyl acrylamide); and salts thereof.

Preferably, the dispersant polymer used in the automatic dishwashing composition of the present invention, comprises a copolymer derived from polymerized units of 50 to 95 wt % (preferably, 70 to 93 wt %) acrylic acid and 5 to 50 wt % (preferably, 7 to 30 wt %) 2-acrylamido-2-methylpropane sulfonic acid sodium salt. More preferably, the dispersant polymer used in the automatic dishwashing composition of the present invention, comprises a copolymer derived from polymerized units of 50 to 95 wt % (preferably, 70 to 93 wt %) acrylic acid and 5 to 50 wt % (preferably, 7 to 30 wt %) 2-acrylamido-2-methylpropane sulfonic acid sodium salt; wherein the copolymer has a weight average molecular weight, Mw, of 2,000 to 40,000 (more preferably, 10,000 to 20,000) Daltons.

Preferably, the dispersant polymer used in the automatic dishwashing composition of the present invention, comprises a homopolymer of (meth)acrylic acid. More preferably, the dispersant polymer used in the automatic dishwashing composition of the present invention, comprises a homopolymer of (meth)acrylic acid; wherein the homopolymer of (meth)acrylic acid has a weight average molecular weight, Mw, of 2,000 to 40,000 (more preferably, 2,000 to 10,000) Daltons.

Preferably, the dispersant polymer used in the automatic dishwashing composition of the present invention, comprises a homopolymer of acrylic acid. More preferably, the dispersant polymer used in the automatic dishwashing composition of the present invention, comprises a homopolymer of acrylic acid; wherein the homopolymer of acrylic acid has a weight average molecular weight, Mw, of 2,000 to 40,000 (more preferably, 2,000 to 10,000) Daltons.

Preferably, the dispersant polymer used in the automatic dishwashing composition of the present invention, comprises a mixture of a homopolymer of acrylic acid and a copolymer derived from polymerized units of acrylic acid and 2-acrylamido-2-methylpropane sulfonic acid sodium salt. More preferably, the dispersant polymer used in the automatic dishwashing composition of the present invention, comprises a mixture of a homopolymer of acrylic acid and a copolymer derived from polymerized units of acrylic acid and 2-acrylamido-2-methylpropane sulfonic acid sodium salt; wherein the homopolymer of acrylic acid has a weight average molecular weight, Mw, of 2,000 to 40,000 (more preferably, 2,000 to 10,000) Daltons; and, wherein the copolymer has a weight average molecular weight, Mw, of 2,000 to 40,000 (more preferably, 10,000 to 20,000) Daltons.

Preferably, the automatic dishwashing composition of the present invention, comprises: 1 to 10 wt % (preferably, 2 to 8 wt %; more preferably, 3 to 6 wt %) of the dispersant polymer, based on the dry weight of the automatic dishwashing composition.

Dispersant polymers used in the automatic dishwashing composition of the present invention are commercially available from various sources, and/or they may be prepared using literature techniques. For instance, low-molecular weight dispersant polymers may be prepared by free-radical polymerization. A preferred method for preparing these polymers is by homogeneous polymerization in a solvent. The solvent may be water or an alcoholic solvent such as 2-propanol or 1,2-propanediol. The free-radical polymerization is initiated by the decomposition of precursor compounds such as alkali persulfates or organic peracids and peresters. The activation of the precursors may be by the action of elevated reaction temperature alone (thermal activation) or by the admixture of redox-active agents such as a combination of iron(II) sulfate and ascorbic acid (redox activation). In these cases, a chain-transfer agent is typically used to modulate polymer molecular weight. One class of preferred chain-transfer agents employed in solution polymerizations is the alkali or ammonium bisulfites. Specifically mentioned is sodium meta-bisulfite.

The dispersant polymer may be in the form of a water-soluble solution polymer, slurry, dried powder, or granules or other solid forms.

Preferably, the builder used in the automatic dishwashing composition of the present invention, comprises one or more carbonates or citrates. The term "carbonate(s)" as used herein and in the appended claims refers to alkali metal or ammonium salts of carbonate, bicarbonate, percarbonate, and/or sesquicarbonate. The term "citrate(s)" as used herein and in the appended claims refers to alkali metal citrates. Preferably, the builder used in the automatic dishwashing composition of the present invention, comprises one or more carbonates or citrates; wherein the carbonates and citrates are selected from the group consisting of carbonate and citrate salts of sodium, potassium and lithium (more preferably, sodium or potassium; most preferably, sodium salts). More preferably, the builder used in the automatic dishwashing composition of the present invention is selected from the group consisting of sodium carbonate, sodium bicarbonate, sodium citrate, and mixtures thereof.

Preferably, the automatic dishwashing composition of the present invention, comprises: 10 to 75 wt % (preferably, 25 to 75 wt %; more preferably, 30 to 70 wt %; most preferably, 40 to 65 wt %) of the builder, based on the dry weight of the automatic dishwashing composition. Weight percentages of carbonates or citrates are based on the actual weights of the salts, including the metal ions.

The automatic dishwashing composition of the present invention, optionally further comprises: an additive. Preferably, the automatic dishwashing composition of the present invention, optionally further comprises: an additive selected from the group consisting of an alkaline source; a bleaching agent (e.g., sodium percarbonate, sodium perborate); a bleach activator (e.g., tetraacetylethylenediamine (TAED)); a bleach catalyst (e.g., manganese(II) acetate, or cobalt(II) chloride); an enzyme (e.g., protease, amylase, lipase, or cellulase); an aminocarboxylate chelant (e.g., methylglycinediacetic acid (MGDA), glutamic acid-N,N-diacetic acid (GLDA), iminodisuccinic acid (IDSA), 1,2-ethylenediamine disuccinic acid (EDDS), aspartic acid diacetic acid (ASDA), salts thereof, and mixtures thereof); a phosphonate (e.g., 1-hydroxy ethylidene-1,1-diphosphonic acid (HEDP)); foam suppressants; dyes; fragrances; silicates; additional builders; antibacterial agents; fillers (e.g., sodium sulfate); and mixtures thereof. Fillers used in automatic dishwashing compositions provided in tablet or powder form include inert, water-soluble substances, typically sodium or potassium salts (e.g., sodium sulfate, potassium sulfate, sodium chloride, potassium chloride) and are typically provided in amounts ranging up to 75 wt % of the automatic dishwashing composition. Fillers used in automatic dishwashing compositions provided in gel form include water in addition to those mentioned above for use in tablet and powder automatic dishwashing compositions. Fragrances, dyes, foam suppressants, enzymes and antibacterial agents used in automatic dishwashing compositions typically account for ≤10 wt % (preferably, ≤5 wt %) of the automatic dishwashing composition.

The automatic dishwashing composition of the present invention, optionally further comprises: an alkaline source. Suitable alkaline sources include, without limitation, alkali metal carbonates and alkali metal hydroxides (e.g., sodium and potassium carbonate, bicarbonate, sesquicarbonate, sodium, lithium, and potassium hydroxide) and mixtures thereof. Sodium carbonate is preferred. Preferably, the automatic dishwashing composition of the present invention comprises 1 to 80 wt % (preferably, 20 to 60 wt %) of an alkaline source (preferably, wherein the alkaline source is sodium carbonate) based on the dry weight of the automatic dishwashing composition.

The automatic dishwashing composition of the present invention, optionally further comprises: a bleaching agent. Preferably, the automatic dishwashing composition of the present invention comprises 1 to 30 wt % (preferably, 8 to 20 wt %) of a bleaching agent, based on the dry weight of the automatic dishwashing composition.

Preferably, the automatic dishwashing composition of the present invention, comprises: sodium carbonate; sodium bicarbonate; a sequestering agent (preferably, wherein the sequestering agent is sodium citrate); a bleaching agent (preferably, wherein the bleaching agent is sodium percarbonate); a bleaching activator (preferably, wherein the bleaching activator is TAED); a surfactant, wherein the surfactant is a fatty alcohol alkoxylate of formula I as described above; an enzyme (preferably, wherein the enzyme is selected from the group consisting of a protease, an amylase, and mixtures thereof); a dispersant polymer (preferably, wherein the dispersant polymer is selected from the group consisting of a homopolymer of acrylic acid, a copolymer of acrylic acid and AMPS (or a salt of AMPS), and mixtures thereof); a phosphonate (preferably, wherein the phosphonate is HEDP); and, optionally, a filler (preferably, wherein the filler is sodium sulfate).

Preferably, the automatic dishwashing composition of the present invention, comprises: 10 to 50 wt % (preferably, 15 to 30 wt %; more preferably, 15 to 25 wt %) sodium carbonate; 5 to 50 wt % (preferably, 10 to 40 wt %; more preferably, 25 to 35 wt %) of a sequestering agent (preferably, wherein the sequestering agent is sodium citrate); 5 to 25 wt % (preferably, 10 to 20 wt %) of a bleaching agent (preferably, wherein the bleaching agent is sodium percarbonate); 1 to 6 wt % (preferably, 2 to 5 wt %) of a bleaching activator (preferably, wherein the bleaching activator is TAED); 0.2 to 15 wt % (preferably, 0.5 to 10 wt %; more preferably, 2 to 7.5 wt %) of a surfactant, wherein the surfactant is a fatty alcohol alkoxylate of formula I as described above; 1 to 6 wt % (preferably, 2 to 4 wt %) of an enzyme (preferably, wherein the enzyme is selected from the group consisting of a protease, an amylase and mixtures thereof; more preferably, wherein the enzyme is a mixture of a protease and an amylase); 1 to 10 (preferably, 2 to 7.5 wt %) of a dispersant polymer (preferably, wherein the dispersant polymer is selected from the group consisting of a homopolymer of acrylic acid, a copolymer of acrylic acid and AMPS (or a salt of AMPS), and mixtures thereof); and 1 to 10 wt % (preferably, 2 to 7.5 wt %) of a filler (preferably, wherein the filler is sodium sulfate); wherein each wt % is based on the dry weight of the automatic dishwashing composition.

Preferably, the automatic dishwashing composition of the present invention has a pH (at 1 wt % in distilled water) of at least 9 (preferably, ≥10). Preferably, the automatic dishwashing composition of the present invention has a pH (at 1 wt % in distilled water) of no greater than 13.

Preferably, the automatic dishwashing composition of the present invention can be formulated in any typical form, e.g., as a tablet, powder, block, monodose, sachet, paste, liquid or gel. The automatic dishwashing compositions of the present invention are useful for cleaning ware, such as eating and cooking utensils, dishes, in an automatic dishwashing machine.

Preferably, the automatic dishwashing composition of the present invention can be used under typical operating conditions. For instance, when used in an automatic dishwashing machine, typical water temperatures during the washing process preferably are from 20° C. to 85° C., preferably 30° C. to 70° C. Typical concentrations for the automatic dishwashing composition as a percentage of total liquid in the dishwasher preferably are from 0.1 to 1 wt %, preferably from 0.2 to 0.7 wt %. With selection of an appropriate product form and addition time, the automatic dishwashing compositions of the present invention may be present in the prewash, main wash, penultimate rinse, final rinse, or any combination of these cycles.

Preferably, the automatic dishwashing composition of the present invention comprises <0.5 wt % (preferably, <0.2 wt %; more preferably, <0.1 wt %; still more preferably, <0.01 wt %; most preferably, <the detectable limit) of phosphate (measured as elemental phosphorus). Preferably, the automatic dishwashing composition of the present invention is phosphate free.

Preferably, the automatic dishwashing composition of the present invention comprises <0.5 wt % (preferably, <0.2 wt %; more preferably, <0.1 wt %; still more preferably, <0.01 wt %; most preferably, <the detectable limit) in total of aminocarboxylate chelants. More preferably, the automatic dishwashing composition of the present invention comprises <0.5 wt % (preferably, <0.2 wt %; more preferably, <0.1 wt %; still more preferably, <0.01 wt %; most preferably, <the detectable limit) in total of aminocarboxylate chelants including methylglycinediacetic acid (MGDA), glutamic acid-N,N-diacetic acid (GLDA), iminodisuccinic acid (IDSA), 1,2-ethylenediamine disuccinic acid (EDDS) and aspartic acid diacetic acid (ASDA). Preferably, the automatic dishwashing composition of the present invention comprises <0.5 wt % (preferably, <0.2 wt %; more preferably, <0.1 wt %; still more preferably, <0.01 wt %; most preferably, <the detectable limit) of methylglycinediacetic acid (MGDA). Preferably, the automatic dishwashing composition of the present invention is aminocarboxylate chelant free. Preferably, the automatic dishwashing composition of the present invention is methylglycinediacetic acid (MGDA) free.

Some embodiments of the present invention will now be described in detail in the following Examples.

Example I-1: Preparation of 12.6C Initiator Solution

A one liter round bottom flask with overhead stirring under a nitrogen atmosphere and equipped with a water cooled distillation head was placed in a temperature controlled electric heating mantle and charged with 686.4 g of a 70:30 wt % mixture of dodecanol and tetradecanol (CO-1270 fatty alcohol available from Proctor & Gamble) and 5.28 g of 85% potassium hydroxide powder to form a mixture. The mixture was then heated to 100° C. to provide a solution having 0.22 wt % water by Karl Fisher analysis. The solution was then further heated to 130 to 140° C., while purging nitrogen from the round bottom flask through the distillation head for two hours to afford a solution containing 0.003 wt % water by Karl Fisher analysis. The base content titrated as 0.61 wt % potassium hydroxide. The remaining 678.10 g solution was poured from the round bottom flask into a bottle and stored at 55° C.

Alkoxylation Reaction Procedure

Alkoxylation reactions were carried out in a 2-L 316 stainless steel conical bottom (minimum stirring volume 20 mL) Parr reactor, model 4530, equipped with a ¼ hp magnetic drive agitator, 1500 watt (115V) Calrod electric heater, ¼ inch water filled cooling coil, 1/16 inch dip tube for sampling, internal thermowell, ¼ inch rupture disc set at 1024 psig, ¼ inch relief valve set at 900 psig, an oxide addition line submerged below the liquid level, and a 2 inch diameter pitch-blade agitator. The bottom of the agitator shaft had a custom-made stainless steel paddle shaped to the contour of the reactor to allow stirring at very low initial volumes. The oxide addition system consisted of a 1 liter stainless steel addition cylinder, which was charged, weighed, and attached to the oxide load line. The reactor system was controlled by a Siemens SIMATIC PCS7 process control system. Reaction temperatures were measured with Type K thermocouples, pressures were measured with Ashcroft pressure transducers, ball valves were operated with Swagelok pneumatic valve actuators, cooling water flow was controlled with ASCO electric valves, and oxide addition rates were controlled by a mass flow control system consisting of a Brooks Quantim® Coriolis mass flow controller (model QMBC3L1B2A1A1A1DH1C7A1DA) and a TESCOM back pressure regulator (model 44-1163-24-109A) which maintained a 100 psig pressure differential across the mass flow controller to afford steady flow rates.

Comparative Examples C1-C7 and C11

In each of Comparative Examples C1-C7 and C11, an alkoxylation reaction was performed in a 2-L 316 stainless steel conical bottom (minimum stirring volume 20 mL) Parr reactor, wherein the Parr reactor was charged with a quantity of the initiator prepared according to Example I-1, was sealed and pressure checked at 450 psig, purged with nitrogen six times and heated to 120 to 130° C. before the addition of ethylene oxide (EO). Then ethylene oxide (EO) was charged to the Parr reactor at a rate of 0.5 to 3 g/min to provide the molar ratio of EO to initiator noted in Table 1. After the pressure in the Parr reactor stabilized, propylene oxide (PO) (if any) and butylene oxide (BO) (if any) were charged to the Parr reactor at a rate of 0.5 to 2 g/min to provide the molar ratio of PO to initiator and BO to initiator noted in Table 1. The Parr reactor was then held at 120 to 130° C. overnight before cooling to 50° C. to recover the product surfactant for use in automatic dishwashing tests described hereinbelow.

TABLE 1

| | Moles per mole of initiator | | | [EO] | [EO]/n, | |
|---|---|---|---|---|---|---|
| Ex. | EO, m | PO | BO, n | (wt %), X | Z | m + n |
| C1 | 10.3 | 12 | 0 | 33.72 | — | — |
| C2 | 10.3 | 0 | 1.2 | 61.73 | 51.4 | 11.5 |
| C3 | 10.3 | 6 | 1.2 | 41.88 | 34.9 | 11.5 |
| C4 | 10.3 | 6 | 1.2 | 41.88 | 34.9 | 11.5 |
| C5 | 10.3 | 0 | 2.4 | 52.23 | 23.0 | 12.7 |
| C6 | 10.3 | 0 | 4.8 | 45.62 | 9.50 | 15.1 |
| C7 | 15.5 | 0 | 2.4 | 64.99 | 27.1 | 17.9 |
| C11 | 20 | 0 | 2 | 72.21 | 36.1 | 22 |

Comparative Examples C8-C10, C12-24 and Examples 1-7

In each of Comparative Examples C8-C10, C12-24 and Examples 1-7, an alkoxylation reaction was in a 2-L 316 stainless steel conical bottom (minimum stirring volume 20 mL) Parr reactor, wherein the Parr reactor was charged with a quantity of the initiator with a basic alkoxylation catalyst in the concentration as noted in Table 2, purged with nitrogen for one hour and heated to 120 to 130° C. before the addition of ethylene oxide (EO). Then ethylene oxide (EO) was charged to the Parr reactor at a rate of 0.5 to 3 g/min to provide the molar ratio of EO to initiator noted in Table 2. After the pressure in the Parr reactor stabilized, propylene oxide (PO) (if any) and butylene oxide (BO) (if any) were charged to the Parr reactor at a rate of 0.5 to 2 g/min to provide the molar ratio of PO to initiator and BO to initiator noted in Table 2. The Parr reactor was then held at 120 to 130° C. overnight before cooling to 50° C. to recover the product surfactant for use in automatic dishwashing tests described hereinbelow.

TABLE 2

| | | Catalyst | Mol/mol initiator | | | [EO] | [EO]/n, | |
|---|---|---|---|---|---|---|---|---|
| Ex. | Initiator, I | (wt % in I)[d] | EO, m | PO | BO, n | (wt %), X | Z | m + n |
| C8 | Octadecanol | 0.75 | 15 | 0 | 2 | 61.44 | 30.7 | 17 |
| C9 | B | 0.41 | 15 | 0 | 2.4 | 64.24 | 26.8 | 17.4 |
| C10 | Octadecanol | 0.75 | 10 | 0 | 2 | 51.51 | 25.8 | 12 |
| C12 | Octadecanol | 0.99 | 23 | 0 | 5 | 61.62 | 12.3 | 28 |
| C13 | B | 1.45 | 23 | 20 | 0 | 41.76 | — | — |
| C14 | B | 1.41 | 23 | 0 | 5 | 64.60 | 12.9 | 28 |
| C15 | C | 0.52 | 18 | 0 | 3 | 62.30 | 20.8 | 21 |
| C16 | C | 0.61 | 28 | 0 | 3 | 71.99 | 24.0 | 31 |
| C17 | C | 0.50 | 18 | 0 | 5 | 55.96 | 11.2 | 23 |
| C18 | C | 0.52 | 18 | 0 | 7 | 50.79 | 7.26 | 25 |
| C19 | C | 0.53 | 23 | 0 | 5 | 61.88 | 12.4 | 28 |
| C20 | C | 0.60 | 28 | 0 | 5 | 66.40 | 13.3 | 33 |
| C21 | D | 0.63 | 18 | 0 | 3 | 62.65 | 20.9 | 21 |
| C22 | D | 0.63 | 25 | 0 | 5 | 64.09 | 12.8 | 30 |
| C23 | D | 0.64 | 23 | 0 | 5 | 62.15 | 12.4 | 28 |
| C24 | D | 0.63 | 28 | 0 | 5 | 66.66 | 13.3 | 33 |
| 1 | B | 1.43 | 23 | 0 | 10 | 52.52 | 5.25 | 33 |
| 2 | C | 0.48 | 28 | 0 | 7 | 61.62 | 8.80 | 35 |
| 3 | D | 0.66 | 25 | 0 | 7 | 59.13 | 8.45 | 32 |
| 4 | D | 0.64 | 28 | 0 | 7 | 61.84 | 8.83 | 35 |
| 5 | D | 0.65 | 31 | 0 | 9 | 60.13 | 6.68 | 40 |

TABLE 2-continued

| Ex. | Initiator, I | Catalyst (wt % in I)[A] | Mol/mol initiator EO, m | PO | BO, n | [EO] (wt %), X | [EO]/n, Z | m + n |
|---|---|---|---|---|---|---|---|---|
| 6 | D | 0.61 | 31 | 0 | 7 | 64.21 | 9.17 | 38 |
| 7 | D | 0.61 | 28 | 0 | 9 | 57.67 | 6.41 | 33 |

[A]Potassium hydroxide (≥85%) available from Sigma-Aldrich

B 70:30 wt % mixture of dodecanol and tetradecanol (CO-1270 fatty alcohol available from Proctor & Gamble)

C 25:17 wt % mixture of hexadecanol and octadecanol (TA-1618 alcohol mixture available from Proctor & Gamble)

D 50:50 wt % mixture of hexadecanol and octadecanol (Nafol ® 1618H linear alcohol mixture available from Sasol)

Procedure for Preparing Food Soil

The food soil formulations described in Tables 3-4 were prepared by heating water to 70° C. and then adding the potato starch, quark powder, benzoic acid and margarine. Agitating until the margarine was well dissolved. Then adding the milk and agitating well. Letting the resulting mixture cool down. Then, when the temperature falls below 45° C., adding the egg yolks, ketchup and mustard. Mixing well and then freezing the resulting food soil formulations in 50 g aliquots for used in the automatic dishwashing tests.

TABLE 3

| Ingredient | Concentration in food soil formulation (wt %) |
|---|---|
| water | 71.1 |
| margarine | 10.2 |
| potato starch | 0.5 |
| Quark powder | 2.5 |
| benzoic acid | 0.1 |
| milk | 5.1 |
| egg yolks | 5.5 |
| ketchup | 2.5 |
| mustard | 2.5 |

TABLE 4

| Ingredient | Concentration in food soil formulation (wt %) |
|---|---|
| water | 70.64 |
| margarine | 10.1 |
| potato starch | 0.5 |
| Quark powder | 2.52 |
| benzoic acid | 0.1 |
| milk | 5.05 |
| egg yolks | 6.05 |
| ketchup | 2.52 |
| mustard | 2.52 |

Dishwashing Compositions

Dishwashing compositions containing surfactants prepared according to Comparative Examples C1-24 and Examples 1-7 above were provided using the component formulations identified in one of Tables 5-7. The protease used in each of the component formulations was Savinase® 12T protease available from Novozymes. The amylase used in each of the component formulations was Stainzyme® 12T amylase available from Novozymes.

TABLE 5

| Ingredient | Concentration in formulation on solids basis (wt %) |
|---|---|
| sodium citrate | 30.0 |
| sodium carbonate | 20.0 |
| sodium bicarbonate | 10.0 |
| percarbonate | 15.0 |
| TAED | 4.00 |
| surfactant | 5.00 |
| dispersant[a] | 5.96 |
| protease | 2.00 |
| amylase | 1.00 |
| HEDP[b] | 2.00 |
| sodium sulfate | 5.04 |

[a]Acusol ™ 588G detergent polymer available from The Dow Chemical Company

[b]Dequest ® 2016DG phosphonate available from Italmatch Chemicals

TABLE 6

| Ingredient | Concentration in formulation on solids basis (wt %) |
|---|---|
| sodium citrate | 30.0 |
| sodium carbonate | 20.0 |
| sodium bicarbonate | 10.0 |
| percarbonate | 15.0 |
| TAED | 4.00 |
| surfactant | 5.00 |
| dispersant[a] | 5.00 |
| protease | 2.00 |
| amylase | 1.00 |
| HEDP[b] | 2.00 |
| sodium sulfate | 6.00 |

[a]50:50 wt % mixture of Acusol ™ 588 detergent polymer and Acusol ™ 902N dispersant polymer available from The Dow Chemical Company

[b]Dequest 2016DG phosphonate available from Italmatch Chemicals

TABLE 7

| Ingredient | Concentration in formulation on solids basis (wt %) |
|---|---|
| sodium citrate | 30.0 |
| sodium carbonate | 20.0 |
| sodium bicarbonate | 10.0 |
| percarbonate | 15.0 |
| TAED | 4.00 |
| surfactant | 5.00 |
| dispersant[a] | 5.96 |
| protease | 2.00 |
| amylase | 1.00 |
| HEDP[b] | 2.00 |
| sodium sulfate | 5.04 |

[a]Acusol ™ 588G detergent polymer available from The Dow Chemical Company

[b]Dequest ® 2010 phosphonate available from Italmatch Chemicals

Dishwashing Test Conditions

Machine: Miele SS-ADW, Model G1222SC Labor. Program: V4, 50° C. wash cycle with heated wash for 8 min, fuzzy logic disengaged, heated dry. Water: 375 ppm hardness (as $CaCO_3$, confirmed by EDTA titration), Ca:Mg=3:1, 250 ppm sodium carbonate. Food soil: 50 g of the compositions noted in Tables 8-14 were introduced at t=0, frozen in a cup. Each surfactant from Comparative Examples C1-C24 and Examples 1-7 was tested in the dishwashing composition, as noted in Tables 8-14, dosed at 20 g per wash.

Filming and Spotting Evaluation

After drying in open air filming and spotting ratings were determined by trained evaluators by observations of glass tumblers in a light box with controlled illumination from below. Glass tumblers were rated for filming and spotting according to ASTM method ranging from 1 (no film/spots) to 5 (heavily filmed/spotted). An average value of 1 to 5 for filming and spotting was determined for each glass tumbler and are reported in Tables 8-14, respectively.

TABLE 8

TEST 1

| Surfactant | Dishwashing Composition | Food Soil | Rating Spotting | Rating Filming |
|---|---|---|---|---|
| Comparative Example C1 | TABLE 5 | TABLE 3 | 5.00 | 1.50 |
| Comparative Example C2 | TABLE 5 | TABLE 3 | 5.00 | 1.25 |
| Comparative Example C3 | TABLE 5 | TABLE 3 | 5.00 | 1.25 |
| Comparative Example C4 | TABLE 5 | TABLE 3 | 5.00 | 1.25 |
| Comparative Example C5 | TABLE 5 | TABLE 3 | 5.00 | 1.50 |
| Comparative Example C6 | TABLE 5 | TABLE 3 | 5.00 | 2.00 |
| Comparative Example C7 | TABLE 5 | TABLE 3 | 5.00 | 1.25 |
| DOWFAX ™ 20B102[1] nonionic surfactant | TABLE 5 | TABLE 3 | 5.00 | 1.50 |

[1]linear alcohol alkoxylate available from The Dow Chemical Company.

TABLE 9

TEST 2

| Surfactant | Dishwashing Composition | Food Soil | Rating Spotting | Rating Filming |
|---|---|---|---|---|
| Comparative Example C8 | TABLE 7 | TABLE 4 | 3.60 | 1.70 |
| Comparative Example C9 | TABLE 7 | TABLE 4 | 4.60 | 1.80 |
| Comparative Example C10 | TABLE 7 | TABLE 4 | 4.70 | 1.80 |
| DOWFAX ™ 20B102[1] nonionic surfactant | TABLE 7 | TABLE 4 | 4.70 | 2.00 |

[1]linear alcohol alkoxylate available from The Dow Chemical Company.

TABLE 10

TEST 3

| Surfactant | Dishwashing Composition | Food Soil | Rating Spotting | Rating Filming |
|---|---|---|---|---|
| Comparative Example C11 | TABLE 7 | TABLE 4 | 4.80 | 2.20 |
| DOWFAX ™ 20B102[1] nonionic surfactant | TABLE 7 | TABLE 4 | 4.80 | 2.30 |

[1]linear alcohol alkoxylate available from The Dow Chemical Company.

TABLE 11

TEST 4

| Surfactant | Dishwashing Composition | Food Soil | Rating Spotting | Rating Filming |
|---|---|---|---|---|
| Example 1 | TABLE 7 | TABLE 4 | 3.30 | 2.80 |
| Comparative Example C12 | TABLE 7 | TABLE 4 | 2.60 | 2.50 |
| Comparative Example C13 | TABLE 7 | TABLE 4 | 4.60 | 2.50 |
| Comparative Example C14 | TABLE 7 | TABLE 4 | 4.80 | 2.90 |
| DOWFAX ™ 20B102[1] nonionic surfactant | TABLE 7 | TABLE 4 | 4.90 | 1.60 |

[1]linear alcohol alkoxylate available from The Dow Chemical Company.

TABLE 12

TEST 5

| Surfactant | Dishwashing Composition | Food Soil | Rating Spotting | Rating Filming |
|---|---|---|---|---|
| Example 2 | TABLE 6 | TABLE 3 | 3.75 | 2.00 |
| Comparative Example C15 | TABLE 6 | TABLE 3 | 4.00 | 1.75 |
| Comparative Example C16 | TABLE 6 | TABLE 3 | 4.50 | 1.25 |
| Comparative Example C17 | TABLE 6 | TABLE 3 | 5.00 | 1.00 |
| Comparative Example C18 | TABLE 6 | TABLE 3 | 5.00 | 1.50 |
| Comparative Example C19 | TABLE 6 | TABLE 3 | 5.00 | 1.00 |
| Comparative Example C20 | TABLE 6 | TABLE 3 | 5.00 | 1.00 |
| DOWFAX ™ 20B102[1] nonionic surfactant | TABLE 6 | TABLE 3 | 5.00 | 1.00 |

[1]linear alcohol alkoxylate available from The Dow Chemical Company.

TABLE 13

TEST 6

| Surfactant | Dishwashing Composition | Food Soil | Rating Spotting | Rating Filming |
|---|---|---|---|---|
| Example 3 | TABLE 6 | TABLE 3 | 2.75 | 3.00 |
| Example 4 | TABLE 6 | TABLE 3 | 4.00 | 1.75 |
| Example 2 | TABLE 6 | TABLE 3 | 4.00 | 1.75 |
| Comparative Example C21 | TABLE 6 | TABLE 3 | 4.75 | 1.38 |
| Comparative Example C22 | TABLE 6 | TABLE 3 | 4.75 | 1.50 |
| Comparative Example C23 | TABLE 6 | TABLE 3 | 5.00 | 1.50 |
| Comparative Example C12 | TABLE 6 | TABLE 3 | 5.00 | 1.38 |
| Dehypon ® E127[1] nonionic surfactant | TABLE 6 | TABLE 3 | 3.00 | 3.00 |

[1]modified fatty alcohol polyglycolether surfactant available from BASF.

TABLE 14

TEST 7

| Surfactant | Dishwashing Composition | Food Soil | Rating Spotting | Rating Filming |
|---|---|---|---|---|
| Example 5 | TABLE 6 | TABLE 3 | 3.38 | 2.25 |
| Example 6 | TABLE 6 | TABLE 3 | 3.63 | 1.81 |
| Example 7 | TABLE 6 | TABLE 3 | 3.63 | 2.19 |
| Comparative Example C24 | TABLE 6 | TABLE 3 | 4.75 | 1.44 |
| Dehypon ® E127[1] nonionic surfactant | TABLE 6 | TABLE 3 | 2.88 | 1.94 |

[1]modified fatty alcohol polyglycolether surfactant available from BASF.

We claim:

1. An automatic dishwashing composition comprising:

a dispersant polymer comprising monomer units of at least one of acrylic acid, methacrylic acid, itaconic acid and maleic acid;

a builder; and a surfactant, wherein the surfactant is a fatty alcohol alkoxylate of formula I:

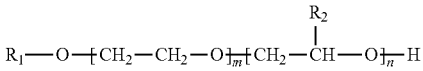

(I)

wherein $R_1$ is selected from the group consisting of a dodecyl group, a tetradecyl group, a hexadecyl group, an octadecyl group and an eicosyl group;

$R_2$ is a $C_2$ alkyl group;

m has an average value of 25 to 31;

n has an average value of 4 to 12;

wherein m+n is an average value of 30 to 40;

wherein the fatty alcohol alkoxylate of formula I has an average ethyleneoxy unit concentration per molecule, X, of 50 to 64.5 wt %; and, wherein the fatty alcohol alkoxylate of formula I has a ratio, Z, equal to the average ethyleneoxy unit concentration per molecule, X, divided by n; wherein the ratio, Z, is 4 to 9.4.

2. The automatic dishwashing composition of claim 1, wherein the dispersant polymer is a homopolymer of (meth) acrylic acid.

3. The automatic dishwashing composition of claim 1, wherein the builder is selected from the group consisting of alkali metal carbonate, alkali metal bicarbonate, alkali metal percarbonate, alkali metal citrate, ammonium carbonate, ammonium bicarbonate, and ammonium percarbonate.

4. The automatic dishwashing composition of claim 1, wherein the builder is selected from the group consisting of sodium carbonate, sodium bicarbonate, sodium citrate, and mixtures thereof.

5. The automatic dishwashing composition of claim 1, further comprising an optional component selected from the group consisting of a bleaching agent, a bleach activator, a bleach catalyst, an enzyme, an aminocarboxylate chelant, a filler, and mixtures thereof.

6. A method of cleaning an article in an automatic dishwashing machine, comprising:

providing at least one article;

providing an automatic dishwashing composition according to claim 1; and, applying the automatic dishwashing composition to the at least one article.

* * * * *